United States Patent [19]

Crist

[11] Patent Number: 4,524,905

[45] Date of Patent: Jun. 25, 1985

[54] MAIL BOX SIGNAL DEVICE

[76] Inventor: Robert M. Crist, R.D. #4, Box 185, Oswego, N.Y. 13126

[21] Appl. No.: 588,398

[22] Filed: Mar. 12, 1984

[51] Int. Cl.[3] ..... B65D 91/00; A47G 29/12

[52] U.S. Cl. ..... 232/35; 232/17

[58] Field of Search ..... 232/34, 35, 17

[56] References Cited

U.S. PATENT DOCUMENTS

| | | | |
|---|---|---|---|
| 2,428,423 | 10/1947 | Hurban | 232/35 |
| 2,730,298 | 1/1956 | Haserodt | 232/35 |
| 3,338,511 | 8/1967 | Cvar | 232/35 |
| 3,866,823 | 2/1975 | Grayson | 232/35 |
| 4,000,847 | 1/1977 | Duis | 232/35 |

*Primary Examiner*—Gene Mancene
*Assistant Examiner*—David I. Tarnoff
*Attorney, Agent, or Firm*—Charles S. McGuire

[57] ABSTRACT

A signal device for attachment to standard, front-opening, outside mail boxes. The device comprises a clip member, a coil spring attached at one end to the clip, and a small flag or other visual indicating means mounted on the opposite end of the spring. The device is installed by inserting the clip over an upper edge of the open end of the mail box, without screws, rivets, or other permanent attachment means and without modifying or piercing the mail box in any way. The coil spring has a normal, unflexed position extending essentially vertically upward from the front, upper edge of the mail box and the device is "set" by flexing the spring downwardly from the end with the box door open to place the flag inside the box. The door is then closed to hold the spring in the flexed position. Upon opening the door, e.g., to insert mail, the spring returns to its upright position and the flag may be observed from a remote location, thereby automatically indicating that the box has been opened.

1 Claim, 4 Drawing Figures

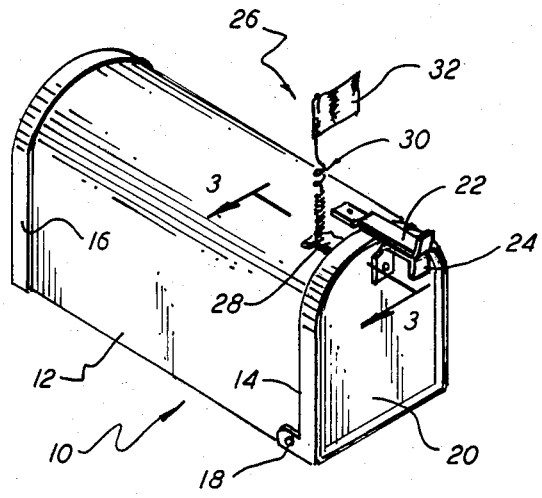
FIG. 1
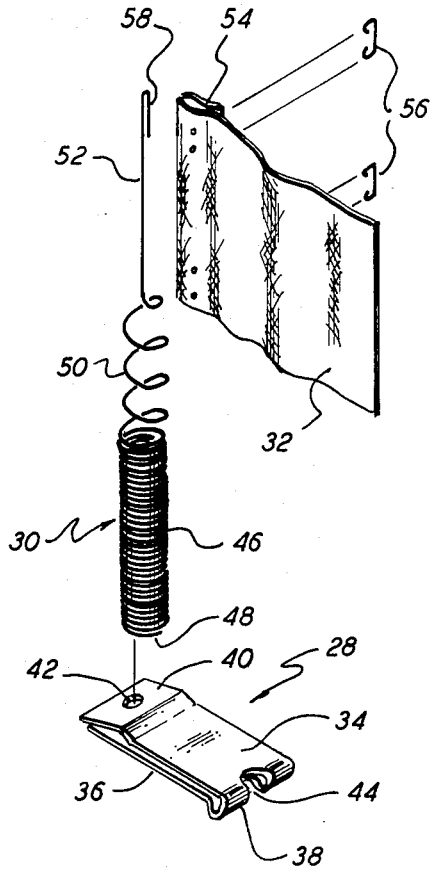
FIG. 2
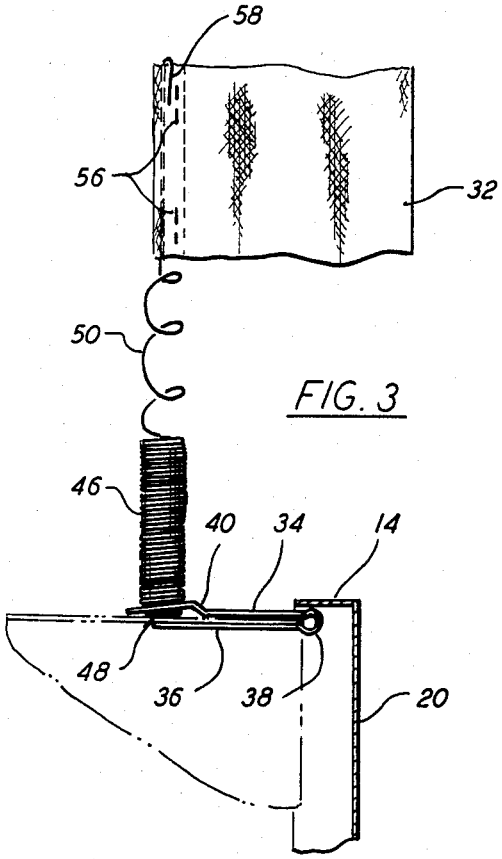
FIG. 3
FIG. 4
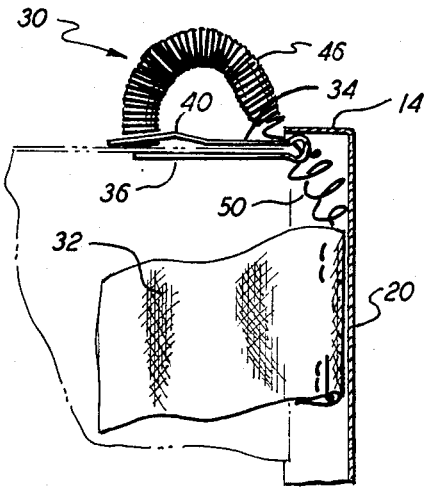

MAIL BOX SIGNAL DEVICE

BACKGROUND OF THE INVENTION

The present invention relates to devices of the type installed upon outside mail boxes to provide a visual indication to an observer at a remote location that the box has been opened, presumably for the purpose of delivering and/or picking up mail.

Mail is delivered in many areas, particularly rural and suburban, to boxes placed at a convenient height at the side of a street or road in proximity to the house or other structure to which it is addressed. The type of outdoor mail box presently in use by the millions and approved by the U.S. Post Office Department is elongated on its horizontal axis and one of the end walls is hinged to the bottom wall for opening and closing movement, usually retained in the closed position by a friction hasp having one piece attached to and extending outwardly from the center of the upper wall of the box and a second, manually engageable piece on the movable front wall or door.

The desireability of having means associated with the box to indicate that the door has been opened has long been recognized, and the prior art contains many examples of devices directed to this purpose. Such devices are most commonly of the type wherein the indication is provided by the position of an indicating member. It is generally found, however, that such devices require hand or sometimes power tools for installation upon the box, and/or that they require some manual manipulation or operation to come to the indicating position, and/or that certain portions are subject to greater stress and wear than others, e.g., by being engaged between the movable door and stationary portions of the box. Other disadvantages of complexity, cost, etc. may also by present.

It is the principal object of the present invention to provide a novel and improved signal device for mounting on a standard, outdoor mail box wherein visual indicating member moves from a set to an indicating position automatically upon opening the mail box door.

A further object is to provide a mail box signal device which is simple in both design and operation, as well as economical to manufacture in both labor and materials.

Another object is to provide an automatically operable signal device which is installed upon a conventional mail box without tools of any kind, and without modifying or piercing the box in any way.

Still another object is to provide a device for signaling that the door of a mail box has been opened which is extremely durable, having no parts subject to wear by friction.

Other objects will in part be obvious and will in part appear hereinafter.

SUMMARY OF THE INVENTION

In furtherance of the foregoing objects, the signal device of the present invention comprises a clip member formed, e.g., from a strip of spring steel bent to provide two closely superposed walls joined along one end for limited flexing movement away from and toward one another. The bend is preferably in a circular configuration, in side view, and includes a cut-out area at the center of the front side. A coil spring is attached at one end to the upper wall of the clip at a point near the free end thereof. A piece of flexible material in the form of a small flag is affixed to the end of the coil spring opposite its connection to the clip member.

The coil is tightly wound for a portion of its length from the end attached to the clip to define a normal or unflexed position with successive turns in contact, and extending along a linear axis substantially perpendicular to the walls of the clip member. The spring is then extended to include several, relatively widely spaced turns for another portion of its length, and extends from this portion to the free or terminal end in a straight line. The flag material is attached by any convenient means to the straight portion of the spring.

The signal device is mounted on the mail box simply by opening the box door and sliding the clip member over the top, front edge of the box, adjacent the stationary portion of the closure hasp, so that the walls of the clip member engage the box wall therebetween. The coil spring extends essentially vertically with the flag displayed above the front of the box. The signal device is "set" by opening the box door, bending the coil spring to a flexed position with the flag inside the box, and closing the door to retain the spring and flag in such positions. The spring is positioned, preferably at a point near the juncture of the tightly and loosely coiled portions, in the cut-out area in the front of the bend at the front of the clip member, whereby it is not pinched between the door and front edge of the mail box.

When the door of the mail box is opened to deposit mail, the spring returns automatically to the unflexed position and the flag again appears above the box. When the mail is removed from the box, the device may be returned to the "set" position.

BRIEF DESCRIPTION OF THE DRAWINGS

FIG. 1 is a perspective view of a conventional mail box with the signal device of the present invention mounted thereon;

FIG. 2 is an exploded perspective view of the signal device of FIG. 1; and FIGS. 3 and 4 are side elevational views of the signal device in the normal or "indicating" and "set" positions, respectively, with a fragment of the mail box shown in section taken on the line 3—3 of FIG. 1.

DETAILED DESCRIPTION

Turning now to the drawing, in FIG. 1 is shown a typical mail box indicated generally by reference numeral 10, of the type primarily employed in outdoor locations within visual observation from a house or other structure to which mail deposited in the box is directed. Box 10 is conventionally shaped and formed, usually of sheet metal, with a flat bottom wall, side and top walls which often but not necessarily merge in arcuate fashion, and front and rear walls which are vertically disposed when box 10 is mounted for use. In the illustrated configuration the bottom, sides and top walls are formed from a single blank of sheet metal to form the body of the box, indicated by reference numeral 12. Both the front and back walls include peripheral flanges 14 and 16, respectively, shaped to closely enclose the front and rear edges of body 12. Portions of flange 14 are pivotally attached at 18, and on the opposite side, to body 12 whereby front wall 20 provides a hingedly attached door, movable to open and close the front end of body 12. The door is maintained in the closed position by a pair of members 22 and 24, respectively attached to body 12 and front wall 20, for frictional engagement when the door is closed.

It is useful to know whether, at any given time, mail has been deposited in the box in order to avoid unnecessary trips to the box which are particularly undesirable in inclement weather, for infirm or handicapped individuals, and for general safety near the roadside where one would be exposed to automobile traffic. While the individual delivering the mail is either not required or not allowed to perform any operations involving manipulation of parts for the purpose of indicating that mail has been placed in the box, devices may be provided which change position automatically, e.g., by gravity or a biasing force, in response to opening of the mail box door. The present invention is of this class of devices, providing a visual indication to an observer at a location remote from the mail box by means of an element which changes positions automatically when the door is opened, after having been placed in a "set" position.

The signal device is denoted generally by reference numeral 26 and includes clip member 28, coil spring 30 and flag 32. Clip member 28 is preferably formed from a strip of spring steel, or other such material bent upon itself to provide closely adjacent, upper and lower portions 34 and 36, respectively, joined at and adapted for limited flexing movement about bend 38. Upper portion 34 is further bent along transverse lines to provide stepped portion 40, spaced slightly from lower portion 36, and having opening 42 formed therein. Bend 38, instead of being simply U-shaped, is preferably of essentially circular configuration in side view, as best seen in FIGS. 3 and 4, and includes a cut-out portion 44 in the central area thereof.

Coil spring 30 is tightly wound in successive turns which preferably contact one another in the unflexed condition of the spring for a first portion 46 of its length from end 48. For a second portion 50 of its length, spring 30 is stretched to a condition wherein the successive turns are relatively widely spaced, and for a third portion 52 extends in an essentially straight line. The wire from which spring 30 is formed, and dimensions of the spring, are such that it assumes a normal, unflexed position along a straight axis through the center of portion 46, as shown in FIG. 3, with portion 52 lying on or closely adjacent this axis.

Spring 30 is firmly attached to clip member 28 by inserting end 48 through opening 42 and turning the spring a few times. Flag 32 is mounted on spring portion 52 by any convenient means, such as folding marginal edge portion 54 back upon itself about spring portion 52 and securing with staples 56, terminal end 58 of spring 30 being bent downwardly over the upper edge of the flag.

Device 26 is installed on mail box 10 simply by inserting clip member 28 over the front edge of body 12 at one side of hasp portion 22. Upper and lower portions 34 and 36 are flexed apart slightly and grip the wall of body 12 firmly therebetween. Spring 30 extends substantially vertically from a position at the central, upper, forward part of box 10. The device is placed in the "set" position by opening the box door, flexing spring portion 46 to the curved position necessary to place flag 32 inside body 12 of the box, as shown in FIG. 4, and closing the door, thereby trapping the spring between front wall 20 (or flange 14 thereof), and the upper, forward edge of body 12. Spring 30 may be held with one hand in portion 46, outside body 12, as the box door is closed with the other hand to place the device in the "set" position of FIG. 4.

Spring 30 is placed between the two portions of box 10 in portion 50, preferably near the juncture thereof with portion 46. An important feature of the invention is the provision of cut-out portion 44 in bend 38 of clip member 28. By placing spring portion 50 in the cut-out portion, the spring is not pinched between the front wall and edge of the box when the door is closed. This will be the case even where the device is employed with mail boxes having a rolled lip on the forward edge of the box which will fit within the circular configuration of bend 38 since the thickness of the material of clip member 28 is preferably at least as great as the diameter of the wire of spring 30. Thus, the spring is not frictionally engaged between two surfaces at any time which significantly prolongs the operating life of device 26.

When the box door is opened, as for depositing mail therein, spring 30 will return to its natural, linear configuration and flag 32 is displayed above the box. Flag 32 is preferably of a brightly colored, plastic material which is flexible, yet self-supporting to extend outwardly from spring portion 52, as illustrated. When mail is picked up, the signal device is again placed in the "set" position to await the next delivery.

What is claimed is:

1. A signal device for use with a conventional outdoor mail box having a body portion with bottom, rear, top and side walls, and a front wall hingedly attached along its lower edge to the lower, front edge of the body portion bottom wall, said front wall providing a door movable between open and closed positions with respect to the forward edges of the walls of the body portion, and cooperating frictional latch members, one fixedly attached to the body portion adjacent the forward edge of the top wall and the other to the door adjacent its upper edge when in the closed position, said signal device comprising, in combination:

(a) a clip member formed of a unitary strip of metal bent upon itself to provide upper and lower portions connected at the band and having a closely superposed normal position with limited flexibility to permit said upper and lower portions to be spread apart for insertion of said clip member on said forward edge of the top wall of said body portion in closely spaced relation to said one latch member, a central portion of said clip member at the bend between said upper and lower portions being removed to provide a cut-out area between two portions of said bend, said upper portion having a through opening adjacent the end opposite said bend;

(b) a coil spring element having a lower end inserted into said opening in said upper portion of said clip member, the successive coils of said spring being wound in contacting relation for a first portion of the length of said spring extending from said lower end, said spring being attached to said clip member by engagement of said upper portion thereof being engaged between two successive coils of said spring near said lower end, the coils of said spring being expanded to significantly spaced relation for a second portion of the length of said spring extending upwardly from said first portion, and said spring being bent to a substantially linear portion extending upwardly from said second portion to an upper terminal end, the normal, unflexed position of said spring extending upwardly from said clip member along a substantially linear axis through said first and second portions and along said linear portion; and (c) flag means attached to said linear portion of said spring adjacent said upper terminal end, the relative dimensions and positions of said clip member, coil spring and flag means being such that said spring may be flexed away from said normal position to place said device in a set position wherein the axis of said spring is curved, said second portion of said spring is positioned in said cut-out area of said clip member, and said flag means is positioned inside said box body portion, said device being retained in such position by placing said door in said closed position to retain said second spring portion between said door and said forward edge of the top wall of said body portion without direct engagement therebetween, said spring returning to said normal position upon opening of said door.

* * * * *